US006964471B2

(12) United States Patent
Tamura et al.

(10) Patent No.: US 6,964,471 B2
(45) Date of Patent: Nov. 15, 2005

(54) HEATING RESISTOR FILM, RECORDING HEAD SUBSTRATE, RECORDING HEAD, AND RECORDING APPARATUS

(75) Inventors: Seiichi Tamura, Kanagawa (JP); Genzo Momma, Kanagawa (JP); Yukihiro Hayakawa, Kanagawa (JP); Yoshinori Kawasaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 10/270,527

(22) Filed: Oct. 16, 2002

(65) Prior Publication Data

US 2003/0076384 A1 Apr. 24, 2003

(30) Foreign Application Priority Data

Oct. 22, 2001 (JP) ..... 2001-323431

(51) Int. Cl.[7] ..... B41J 2/05
(52) U.S. Cl. ..... 347/62; 347/56
(58) Field of Search ..... 347/61–65, 20, 347/56, 67; 219/216; 338/306–309; 252/518.1, 252/521.3, 521.5

(56) References Cited

U.S. PATENT DOCUMENTS

| | | | | |
|---|---|---|---|---|
| 5,376,231 | A | 12/1994 | Matsumoto et al. | 156/656 |
| 6,068,369 | A * | 5/2000 | Saito et al. | 347/62 |
| 6,070,968 | A | 6/2000 | Akino et al. | 347/59 |
| 2002/0033750 | A1 * | 3/2002 | Oizumi et al. | 338/308 |

FOREIGN PATENT DOCUMENTS

| | | |
|---|---|---|
| EP | 0825026 | 2/1998 |
| JP | 10-114071 | 5/1998 |

* cited by examiner

*Primary Examiner*—Juanita D. Stephens
(74) *Attorney, Agent, or Firm*—Fitzpatrick, Cella, Harper & Scinto

(57) ABSTRACT

To provide a heating resistor film having a sufficiently high durability to repetitive pulse applications, a recording head substrate including the heating resistor film, a recording head, and a recording apparatus. A heating resistor film that generates heat energy using currents flowing from a wire in a heat acting portion of a recording head substrate, is made of amorphous tantalum silicon nitride having a sheet resistance of 200 Ω/□ to 400 Ω/□, and has a thickness of 30 nm to 80 nm.

5 Claims, 5 Drawing Sheets

HEATING RESISTOR FILM, RECORDING HEAD SUBSTRATE, RECORDING HEAD, AND RECORDING APPARATUS

BACKGROUND OF THE INVENTION

1. Field of the Invention

The present invention relates generally to a recording apparatus that forms images such as, for example, characters on a recording material on which the images are to be formed such as paper, a plastic, a sheet, cloth, an article, or the like. The present invention also relates to a recording head used in the recording apparatus, a recording head substrate, and a heating resistor.

2. Related Background Art

An ink jet recording apparatus records high-definition images by discharging ink as minute droplets from a discharge port onto a recording material. The ink jet recording apparatus converts electric energy to heat energy and generates air bubbles in the ink using the heat energy. The force exerted by the air bubbles allows the droplets to be ejected from the discharge port located at the tip of an ink jet recording head. The droplets ejected from the discharge port adhere onto the recording material and thereby images are recorded. Generally, the ink jet recording head used in such an ink jet recording apparatus has a heating resistor that converts electric energy to heat energy.

The heating resistor is a thermal converter that converts electric energy to heat energy to be generated. The heating resistor is protected with an upper protective layer so as not to come into contact with ink.

FIG. 5 is a sectional view of a substrate for an ink jet recording head. With reference to FIG. 5, an $SiO_2$ interlayer film 52 is disposed on an Si substrate 51, and a heating resistor 53 made of TaSiN or the like is formed on the interlayer film 52. An Al wire 54 is provided on the heating resistor 53, but there is a region where the wire 54 is not formed on the heating resistor 53. This region serves as a portion 57 on which heat acts (hereinafter referred to as a heat acting portion 57). In addition, there is provided a protective layer 55 for protecting the heating resistor 53 and the wire 54 from ink penetration or the like. In the heat acting portion 57, a Ta anticavitation film 56 for protecting the protective layer 55 from chemical and physical damages accompanying heat generation is disposed on the protective layer 55.

The current flowing in the wire 54 flows into the heating resistor 53 in the heat acting portion 57 and thereby the electric energy is converted into heat energy. Then the heat energy allows the recording head to discharge ink onto the recording material. In order to record a desired image on the recording material, ON-OFF switching of the current flowing into the heating resistor 53 controls the discharge of ink. Hence, pulsed currents are applied to the heating resistor 53 repetitively.

When it is tried to record images at high speed, which is a natural requirement for recording apparatuses, it is necessary to increase the frequency of the pulsed current, i.e. the drive frequency of the heating resistor 53. Furthermore, in order to improve image quality, the amount of ink to be discharged per dot must be reduced. When it is tried to maintain a high recording speed and to achieve a reduction in size of the heating resistor 53 at the same time, the increase in the drive frequency is required.

Repetitive applications of pulsed currents change the resistance value of the heating resistor 53 and eventually cause breaking of wire. It is assumed that the change in resistance value of the heating resistor 53 is caused by crystallization and a surface oxidation reaction. When the resistance value of the heating resistor 53 changes, the heat energy generated therein changes. When the heat energy used for ink discharge becomes too low, ink is not discharged from the discharge port. Furthermore, when the heat energy becomes too high, ink is spattered over a broad area of the recording material and thereby normal images cannot be recorded. This is so-called "uneven printing". Hence, the heating resistor 53 is required to have durability to the repetitive pulse applications.

Heating resistors with a relatively low resistance value, which have a sheet resistance of about 25 Ω/□ to 50 Ω/□, are used as conventional heating resistors. It has been studied to use heating resistors with a high resistance value of about 200 Ω/□ to 400 Ω/□ so as to reduce power consumption in the recording apparatus without decreasing the heat energy generated therein.

For instance, Japanese Patent Application Laid-Open No. 10-114071 discloses an ink jet recording head with a heating resistor made of TaSiN, TaSiO, or TaSiC having a specific resistance value of 4000 μΩ·cm or less. In addition, it describes, for example, a method for forming a TaSiN heating resistor with a thickness of 100 nm having a sheet resistance of 270 Ω/□ by reactive sputtering.

The conventional heating resistor described in Japanese Patent Application Laid-Open No. 10-114071 has a resistivity change ratio of about 1.0 to 3.0% when the number of repetitive pulse applications is set to $3.0\times10^8$ and has durability to an extent that allows no breaking of wire to be caused when the number of repetitive pulse applications is set to $5.0\times10^9$ in a durability test with respect to the repetitive pulse applications. Here, the "resistivity change ratio" denotes the rate of change of resistance value after the repetitive pulse applications with respect to that before the repetitive pulse applications. The resistivity change ratio is expressed by (A'−A)/A, wherein A and A' denote the resistances before and after the pulse applications, respectively.

The heating resistor is used not only for an ink jet recording head but also for a thermal head for recording images by being brought into direct contact with heat sensitive paper or an ink ribbon.

The need for high durability of heating resistors is increasing more and more. At present, durability is required that allows a heating resistor to withstand pulse applications repeated about $1.0\times10^9$ times. In order to avoid the conditions where ink is not discharged or uneven printing occurs, a resistivity change ratio of 5.0% or lower is required. Hence, it is necessary to meet the above-mentioned requirement in a heating resistor having a high resistance value of about 200 Ω/□ to 400 Ω/□.

SUMMARY OF THE INVENTION

The present invention has been made in view of the above, and an object of the invention is therefore to provide a heating resistor having sufficiently high durability to repetitive pulse applications, a recording head substrate including the heating resistor, a recording head, and a recording device.

According to the present invention, there is provided a heating resistor film, comprising a metal silicide nitride as a main component and having a sheet resistance of 200 Ω/□ to 400 Ω/□, in which a film thickness is 30 nm to 80 nm.

According to this, the heating resistor has a resistivity change ratio of 5% or lower, before and after pulse applications repeated $1.0\times10^9$ times. Hence, the heating resistor has high durability to the repetitive pulse applications.

According to an aspect of the present invention, the heat resistor film is characterized in that the heating resistor film is made of amorphous tantalum silicon nitride.

According to the present invention, there is provided a recording head substrate with a layered structure, comprising a heating resistor film that generates heat energy used for recording an image on a recording material, contains a metal silicide nitride as a main component, and has a sheet resistance of 200 Ω/□ to 400 Ω/□, in which the heating resistor film has a thickness of 30 nm to 80 nm.

According to an aspect of the present invention, the recording head substrate is characterized in that the heat energy generated by the heating resistor film is used for discharging ink onto the recording material.

According to this, the heating resistor film has a resistivity change ratio of 5% or lower, before and after pulse applications repeated $1.0\times10^9$ times. Hence, the recording head substrate has high durability that is sufficient for the substrate to be used in a recording apparatus employing the system in which ink is discharged.

Further, according to an aspect of the present invention, the recording head substrate is characterized in that the heat energy generated by the heating resistor film is used for causing film boiling of the ink and allowing the ink to be ejected from a discharge port.

According to this, the heating resistor film has a resistivity change ratio of 5% or lower, before and after the pulse applications repeated $1.0\times10^9$ times. Hence, the recording head substrate has high durability that is sufficient for the substrate to be used in a recording apparatus employing the system in which ink is subjected to film boiling to be discharged.

According to an aspect of the present invention, the recording head substrate is characterized in that the heating resistor film is made of amorphous tantalum silicon nitride.

According to the present invention, there is provided a recording head for recording an image on a recording member, including a heat resistor film that contains a metal silicide nitride as a main component and has a sheet resistance of 200 Ω/□ to 400 Ω/□, the recording head using heat energy generated by the heat resister film for the recording, in which the heating resistor film has a thickness of 30 nm to 80 nm.

According to an aspect of the present invention, the recording head is characterized in that the recording head further includes an ink flow path inside of which ink flows and a discharge port in communication with the ink flow path, and the recording head discharges ink flowing inside the ink flow path onto the recording material from the discharge port using the heat energy generated by the heating resistor film.

Further, according to an aspect of the present invention, the recording head is characterized in that the recording head provides the ink with heat energy higher than that required for film boiling by the heating resistor film to eject the ink from the discharge port.

According to an aspect of the present invention, the recording head is characterized in that the heating resistor film is made of amorphous tantalum silicon nitride.

According to the present invention, there is provided a recording apparatus, comprising:

means for conveying a recording material; and a recording head for recording an image on a recording material, including a heat resistor film that contains a metal silicide nitride as a main component and has a sheet resistance of 200 Ω/□ to 400 Ω/□, the recording head using heat energy generated by the heat resistor film for the recording in which the heating resistor film has a thickness of 30 nm to 80 nm.

Further, according to an aspect of the present invention, the recording apparatus is characterized in that the recording head further includes an ink flow path inside of which ink flows and a discharge port in communication with the ink flow path, and the recording head discharges ink flowing inside the ink flow path onto the recording material from the discharge port using the heat energy generated by the heating resistor film.

Further, according to an aspect of the present invention, the recording apparatus is characterized in that the recording head provides the ink with heat energy higher than that required for film boiling by the heating resistor film to eject the ink from the discharge port.

Further, according to an aspect of the present invention, the recording apparatus is characterized in that the heating resistor film is made of amorphous tantalum silicon nitride.

According to the present invention, it is characterized in that an amount of oxygen contained in the heating resistor film is less than 3 atom % and the heating resistor film is in contact with an oxide insulating material.

DESCRIPTION OF THE PREFERRED EMBODIMENTS

Embodiments of the present invention are described in detail with reference to the drawings.

Figure 1:
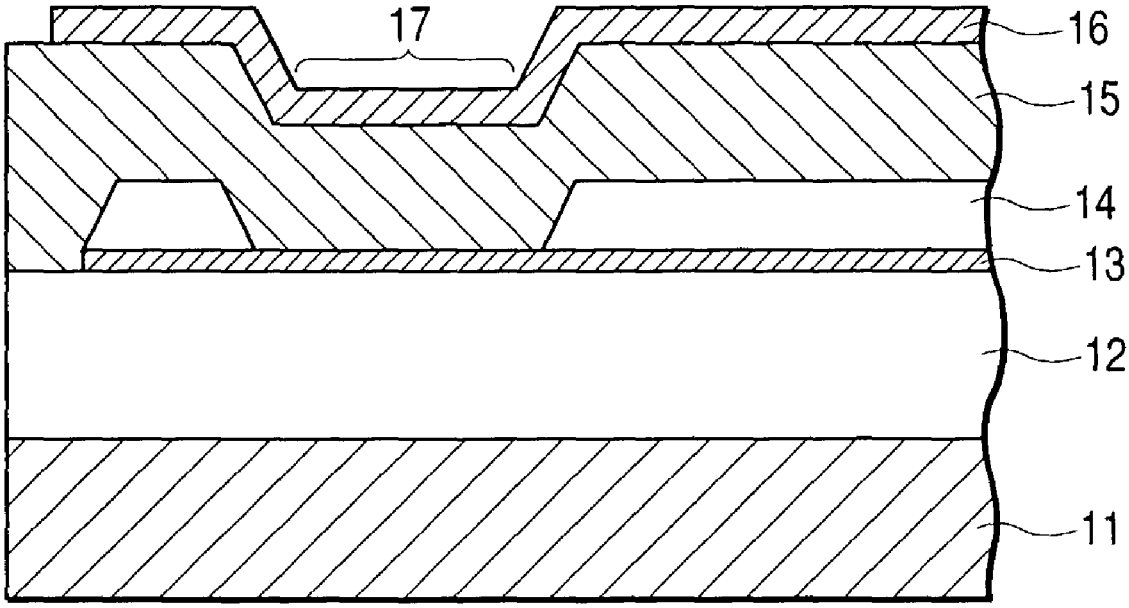
FIG. 1 is a sectional view of a substrate for an ink jet recording head according to an embodiment of the present invention.

FIG. 1 is a sectional view of a substrate for an ink jet recording head according to an embodiment of the present invention. For instance, a recording head with the substrate for an ink jet recording head according to the present embodiment includes: a substrate for an ink jet recording head having a heating resistor film; an ink flow path where the ink is heated by heat energy generated in the heating resistor film; and a discharge port that is in communication with the ink flow path. In the recording head, the ink in the ink flow path is subjected to film boiling by the heat energy generated in the heating resistor film to be discharged from the discharge port.

With reference to FIG. 1, there is provided an interlayer film 12 formed of an oxide insulating material such as, for example, $SiO_2$ on an Si substrate 11. This interlayer film functions as a heat storage layer for accumulating heat moderately. A heating resistor 13 containing a metal silicide nitride such as amorphous TaSiN as a main component is formed on the interlayer film 12. The interlayer film 12 has a thickness of, for example, 280 nm and the heating resistor 13 has a film thickness selected from the range between 30 nm and 80 nm. The heating resistor 13 contains elements of Ta, Si, and N at a predetermined ratio and is made of a material having a sheet resistance of 200 Ω/□ to 400 Ω/□. In order to obtain the above-mentioned sheet resistance, for example, in the case of amorphous TaSiN, Ta, Si, and N may be contained at a predetermined composition ratio obtained by being selected from the range of 25 atom % to 35 atom %, the range of 18 atom % to 25 atom %, and the range of 40 atom % to 50 atom %, respectively.

For instance, a desired value of sheet resistance was obtained through the control of the ratio between Ta and N with Si being set to be about 20 atom %. When the amorphous TaSiN was used in which Ta, Si, and N were set to be 32 atom %, 21 atom %, and 44 atom %, respectively, the heating resistor 13 had a sheet resistance of 300 Ω/□. (The rest that makes up 100 atom % includes atoms such as carbon that are introduced and detected undesirably. Oxygen atoms included in the rest, however, are less than 3 atom % or do not exceed the detection limit.) Furthermore, when the amorphous TaSiN was used in which Ta, Si, and N were set to be 34 atom %, 23 atom %, and 42 atom %, respectively, the heating resistor 13 had a sheet resistance of 200 Ω/□.

In addition, when the amorphous TaSiN was used in which Ta, Si, and N were set to be 29 atom %, 20 atom %, and 46 atom %, respectively, the heating resistor 13 had a sheet resistance of 400 Ω/□.

An Al wire 14 is disposed on the heating resistor 13, but there is a region where the wire 14 is not provided on the heating resistor 13. This region serves as a heat acting portion 17. The wire 14 has a thickness of 200 nm to 600 nm.

Furthermore, a protective layer 15 is provided for protecting the heating resistor 13 and the wire 14 from ink penetration or the like. The protective layer 15 is formed by plasma CVD and is made of silicon nitride (P-SiN) or the like. In the heat acting portion 17, an anticavitation film 16 made of Ta or the like for protecting the protective layer 15 from chemical and physical damages accompanying heat generation is provided on the protective layer 15. The protective layer 15 has a thickness of, for example, 300 nm to 800 nm and the anticavitation film 16 has a thickness of, for instance, 230 nm.

Figure 2:
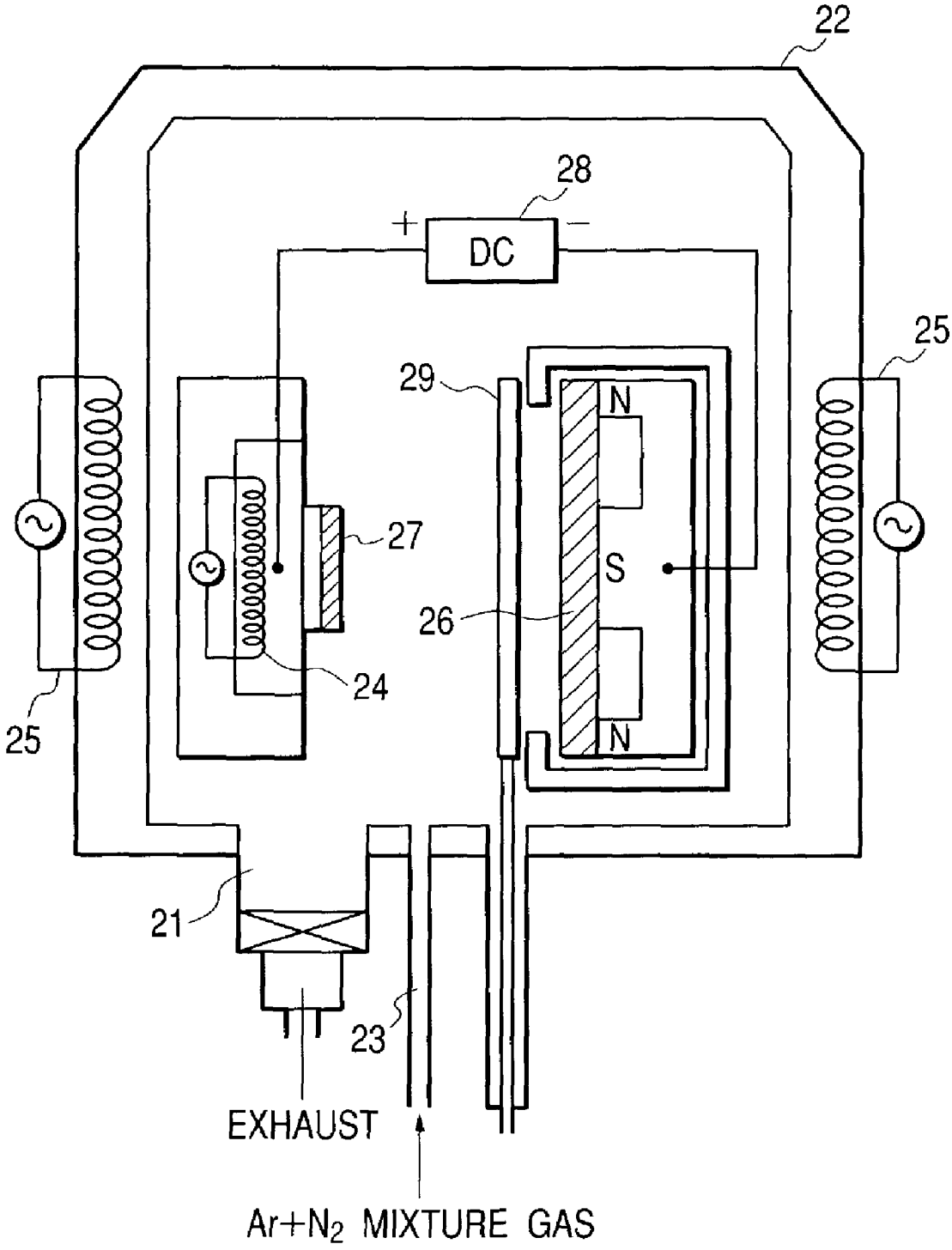
FIG. 2 is a drawing used for explaining an example of methods for forming a heating resistor according to the present embodiment.

FIG. 2 is a drawing used for explaining an example of methods for forming the heating resistor according to the present embodiment. As shown in FIG. 2, first, the air in a deposition chamber 22 is exhausted with an exhaust pump 21 and then a mixture gas consisting of argon and nitrogen is introduced from a gas inlet 23 into the deposition chamber 22. While the mixture gas is introduced, substrate temperature and atmosphere temperature are adjusted to be predetermined temperatures using an internal heater 24 and external heaters 25. Next, voltage is applied between a target 26 made of a Ta-Si alloy and a substrate 27 by a power supply 28 to cause sputtering discharge and thereby a TaSiN thin film is formed on the substrate 27 while the sputtering discharge is controlled by a shutter 29. The target 26 contains Ta and Si at a ratio of, for example, 60:40.

Here, the description was directed to the method of depositing a heating resistor by a reactive sputtering method using the alloy target. The heating resistor, however, may be formed by a reactive cosputtering method using two separate targets of Ta and Si. In this case, voltages applied to respective targets can be controlled separately.

Furthermore, the heat acting portion is formed as follows: an Al film is formed on the heat resistor by a sputtering method and is patterned by photolithography; and part of the Al film is removed. Then, an SiN protective layer is formed thereon by the plasma CVD method. In the heat acting portion, a Ta anticavitation layer is formed by the sputtering method.

The above-mentioned methods of forming the respective layers are described merely as examples. It is to be understood that the present invention is not limited by the examples and the respective layers also can be formed by other methods.

Figure 3:
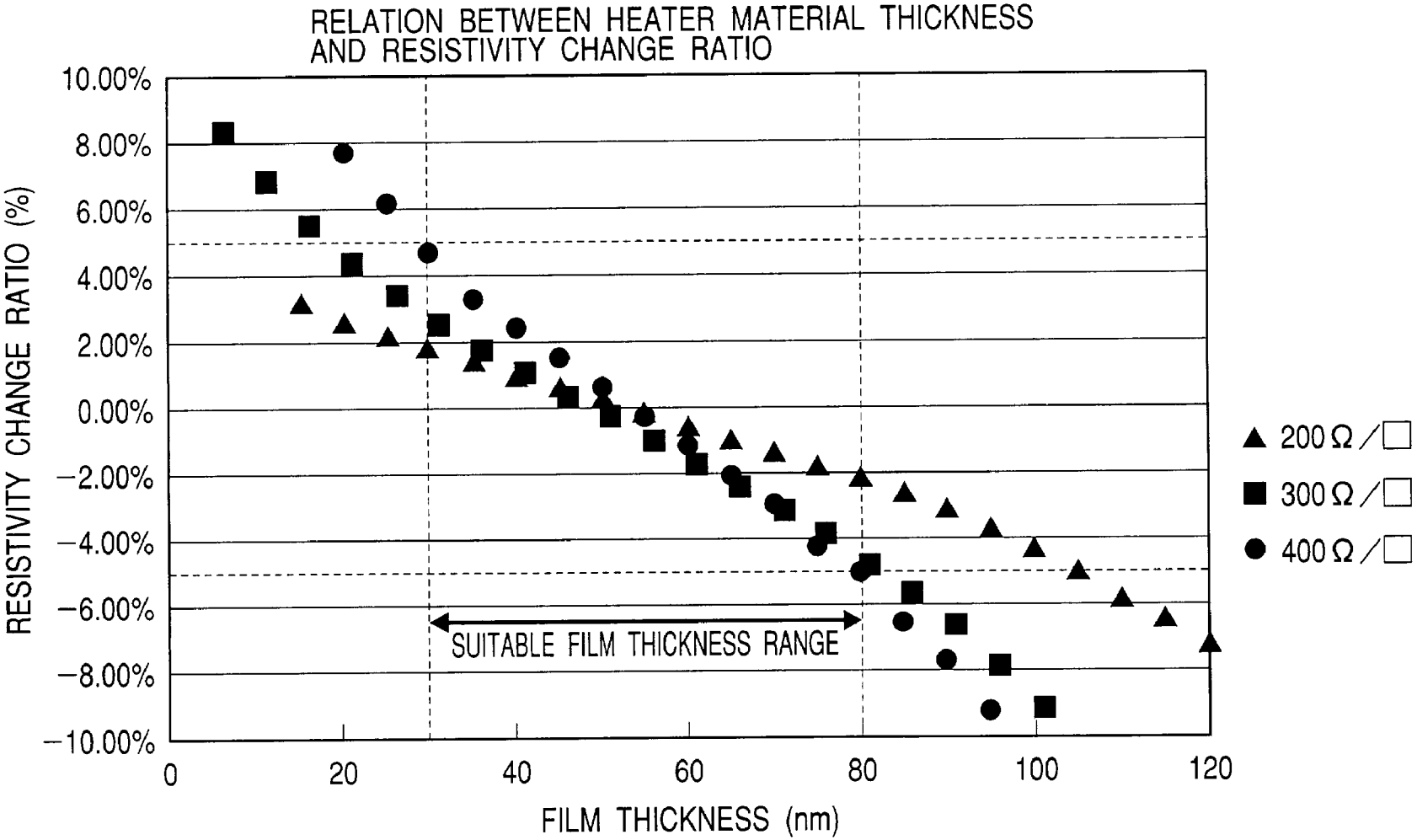
FIG. 3 is a graph showing values of resistivity change ratios determined in the durability test carried out for a plurality of examples with varied film thicknesses.

FIG. 3 is a graph-showing the values of resistivity change ratios determined in a durability test carried out for a plurality of examples with varied thicknesses.

As examples of the present invention, first, a plurality of recording head substrates, each including a heating resistor with a sheet resistance of 200 Ω/□, were formed with the thickness of the heating resistor varied within the range of 20 nm to 120 nm. Then, the durability test was conducted thereon. The conditions of the durability test were as follows: a drive frequency was set to be 10 kHz, a pulse width to be 2 μm, a drive voltage to be 1.3 times the foaming voltage, and the number of repetitive pulse applications to be $1.0\times10^9$. The "foaming voltage" denotes a drive voltage at which the substrate for an ink jet recording head of each example allows ink to start foaming.

In the respective examples, the values of resistance were measured before and after the repetitive pulse applications and then the resistivity change ratios were calculated.

Similarly, a plurality of recording head substrates each of which included a heating resistor having a sheet resistance of 300 Ω/□ and those each of which included a heating resistor having a sheet resistance of 400 Ω/□ were formed with the thickness of the heating resistor varied within the range of 20 nm to 120 nm. Then, the durability test was conducted thereon under the same conditions as in the case where the sheet resistance was 200 Ω/□.

With reference to FIG. 3, it is found that in any of the heating resistors having a sheet resistance within the range of 200 Ω/□ to 400 Ω/□, those having a resistivity change ratio within ±5% in the durability test conducted through the pulse applications repeated $1.0\times10^9$ times are those having a thickness in the range of 30 nm to 80 nm.

When the thickness is reduced to be thinner than 30 nm, the resistance increases rapidly due to the oxidation of metal silicide nitride. In the graph, the inflection point is found at the point where the thickness is 30 nm. The oxidation seems to be caused by the interlayer film (oxide silicon) disposed under and in contact with the heat resistor film.

When the thickness exceeds 80 nm, the resistance decreases rapidly due to crystallization of the amorphous metal silicide nitride. In the graph, the inflection point is found at the point where the thickness is 80 nm. It seems that an increased thickness above a certain thickness allows crystal grains to grow readily.

When using a substrate for an ink jet recording head having a thickness in the range of 30 nm to 80 nm, high quality images can be recorded at high speed over a long period with low power consumption.

Figure 4:
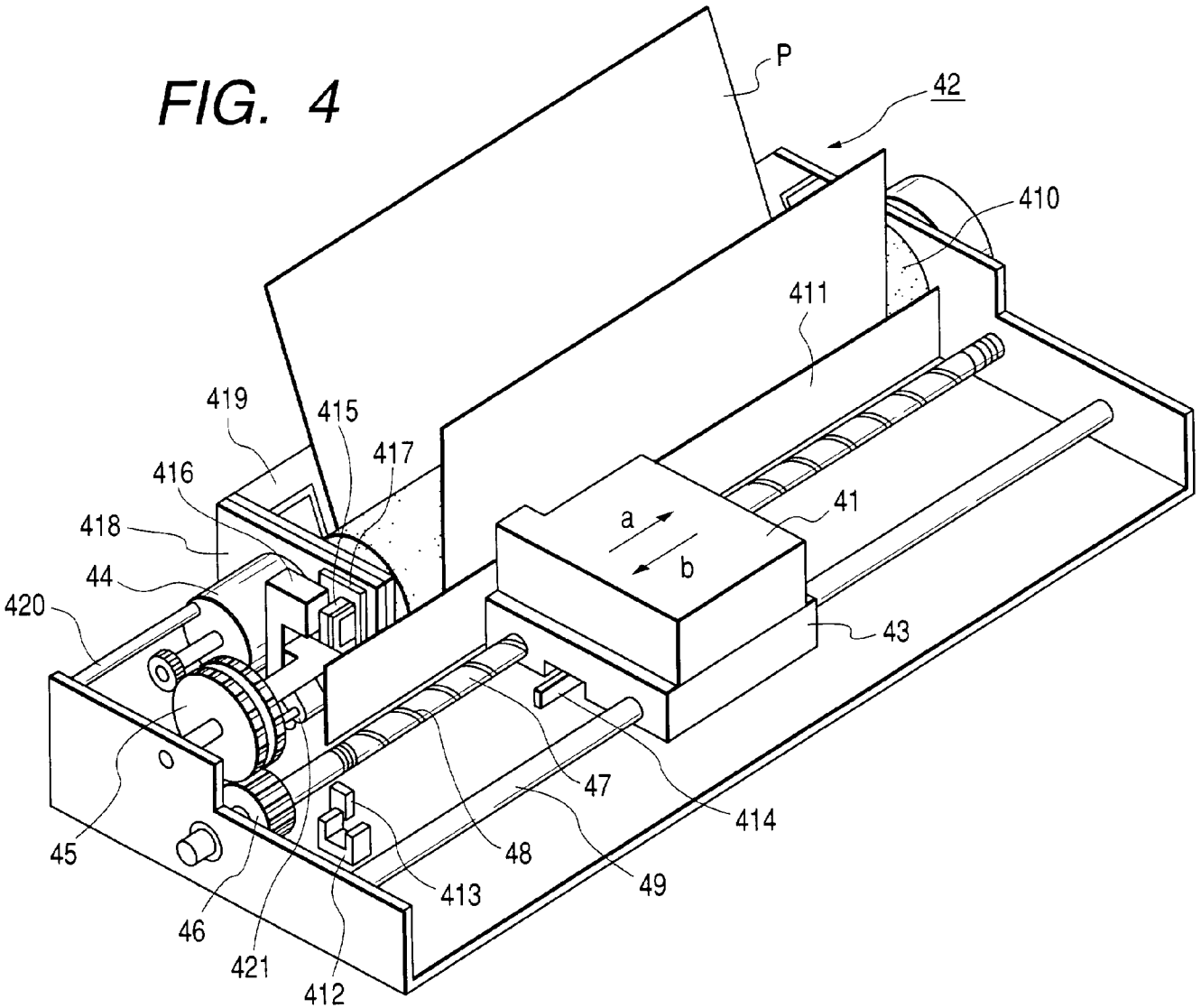
FIG. 4 is an external view of a recording apparatus provided with the ink jet recording head according to an embodiment of the present invention.
Figure 5:
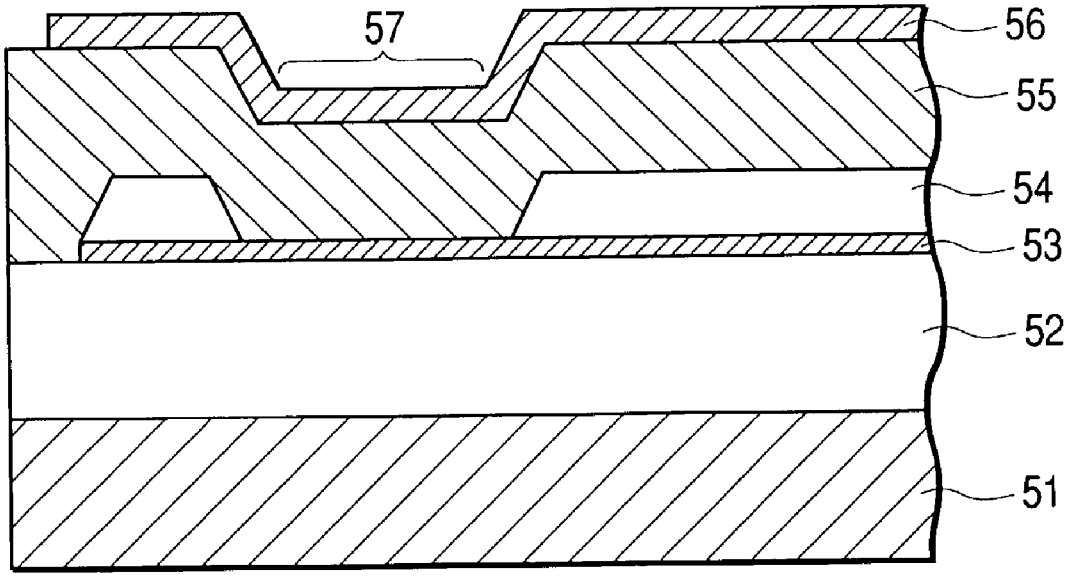
FIG. 5 is a sectional view of a substrate for an ink jet recording head.

FIG. 4 is an external view of a recording apparatus provided with an ink jet recording head according to an embodiment of the present invention. With reference to FIG. 4, an ink jet recording head 41 is mounted on a carriage 43 of an ink jet recording apparatus 42. Driving force of a drive motor 44 that rotates forward or backward is transmitted by driving force transmission gears 45 and 46, and thereby rotates a lead screw 47 forward or backward. The carriage 43 is engaged with a spiral groove 48 of the lead screw 47 and move reciprocally in the directions indicated with arrows a and b along a guide 49 in synchronization with the forward or backward rotation of the drive motor 44.

Recording paper P fed onto a platen 410 by a recording material feeding device, which is not shown in the drawing, is pressed against the platen 410 by a paper holding plate 411 within the range where the carriage 43 moves.

A home position detection means includes photocouplers 412 and 413 having a light-emitting part and a light-receiving part. The home position detection means detects the home position through detecting the state where a lever 414 projecting from the carriage 43 has entered the photocouplers. The home position is used, for example, for changing the direction of rotation of the drive motor 44.

A cap member 415 caps an ink jet recording head 41. A suction unit 416 exerts suction inside the cap member 415 to permit suction recovery of the ink jet recording head 41.

A cleaning blade 417 is moved back and forth by a shifting member 418. The cleaning blade 417 and the shifting member 418 are supported by a body supporting plate 419.

A lever 420 for initiating the suction recovery moves according to the movement of a cam 421 that is engaged with the carriage 43. This allows driving force transmitted from the drive motor 44 to be controlled through a well-known transmission means such as, for instance, clutch change.

A recording control unit that is not shown in the figure allows currents to flow into the heating resistor of the ink jet recording head 41. Images are recorded on the recording paper P through the control of drive of each mechanism described above. A recording material feeding device, which is not shown in the figure, feeds the recording paper P onto the platen 410. Then, while reciprocating over the overall width of the recording paper P, the recording head 41 discharges ink to record images.

The substrate for an ink jet recording head shown in FIG. 1 is used in the recording head 41. This allows the ink jet recording apparatus 42 to record high quality images at high speed over a long period.

In the above description, amorphous tantalum silicon nitride was used as an example. The present invention, however, is not limited thereto and other amorphous materials of metal nitride silicide may be used including, for instance, amorphous silicon nitride titanium and amorphous silicon nitride tungsten.

The substrate according to the present invention is particularly effective in an ink jet recording head in which high speed drive is required. Hence, the above description was directed to the example in which the substrate was used in an ink jet recording head. However, the substrate according to the present invention also can be used for a thermal head.

EXAMPLE

The surface of a silicon substrate was thermally oxidized and thereby an oxide silicon film with a thickness of about 280 nm was formed.

On the oxide silicon film was formed an amorphous tantalum silicon nitride film with a thickness of about 50 nm by the aforementioned reactive sputtering under the following conditions.

Target: TaSi target with a ratio Ta/Si =60/40
Pressure: 0.5 Pa
Diameter of an Electrode: about 200 mm
Making Power: 1 kW
Argon Flow Rate: 63 sccm
Nitrogen Flow Rate: 19 sccm The amorphous tantalum silicon nitride film thus formed was an amorphous TaSiN film having a composition including 32.0 atom % of Ta, 21.2 atom % of Si, 43.8 atom % of N, and 1.5 atom % of oxygen (the rest was not analyzed). It had a sheet resistance of about 300 Ω/□.

On the amorphous TaSiN film was formed a metal film made of aluminum copper by sputtering to have a thickness of about 600 nm.

The amorphous TaSiN film and the aluminum copper film were patterned into the shape of a heating resistor by sputter etching. Then, a portion of the aluminum copper film that was located in the region to be a heat acting portion was removed by wet etching.

After that, a silicon nitride film with a thickness of about 600 nm was formed by the plasma CVD method. Furthermore, a tantalum film with a thickness of about 230 nm was formed thereon by sputtering and then was patterned.

With respect to the heating resistor sample thus obtained, the aforementioned durability test was conducted. As a result, the resistive change ratio was almost 0%.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A recording head substrate with a layered structure comprising:

a heat resistor film that generates heat energy used for recording an image on a recording material, that has a sheet resistance of 200 Ω/□ to 400 Ω/□, that contains a tantalum silicide nitride as a main component, and that has a thickness of 30 nm to 80 nm; and an interlayer comprising an oxide insulating material which is in contact with the heat resistor film.

2. The recording head substrate according to claim 1, further comprising a protective layer arranged on at least a part of the heat resistor film.

3. The recording head substrate according to claim 1, wherein the recording head substrate comprises a plurality of heat resistor films disposed on a substrate.

4. A recording device comprising a recording head according to claim 1.

5. The recording head substrate according to claim 1, wherein a composition ratio of Ta and N is set as Ta: 25–35 atom % and N: 40–50 atom % for the tantalum silicide nitride.

* * * * *